United States Patent [19]

Morimoto et al.

[11] Patent Number: 4,834,281

[45] Date of Patent: May 30, 1989

[54] POROUS METALLIC MATERIAL, POROUS STRUCTURAL MATERIAL AND POROUS DECORATIVE SOUND ABSORBING MATERIAL, AND METHODS FOR MANUFACTURING THE SAME

[75] Inventors: Toru Morimoto, 3-58-2, Wakamiya, Ichikawa-shi, Chiba; Fumihiro Nakagawa, Kyoto, both of Japan

[73] Assignees: Unix Corporation Ltd., Tokyo; Toru Morimoto, Chiba, both of Japan

[21] Appl. No.: 153,028

[22] Filed: Feb. 19, 1988

Related U.S. Application Data

[62] Division of Ser. No. 48,667, May 11, 1987.

[30] Foreign Application Priority Data

| | | | |
|---|---|---|---|
| May 12, 1986 | [JP] | Japan | 61-107972 |
| Nov. 4, 1986 | [JP] | Japan | 61-262468 |
| Jan. 14, 1987 | [JP] | Japan | 62-7013 |

[51] Int. Cl.[4] ..... B32B 3/12; B23K 20/04

[52] U.S. Cl. ..... 228/117; 228/175; 228/181; 228/235; 228/265

[58] Field of Search ..... 228/115, 117, 136, 175, 228/178, 181, 187, 193, 231, 235, 243, 265; 428/605, 608, 613, 593, 603; 181/292, 294

[56] References Cited

U.S. PATENT DOCUMENTS

| | | | |
|---|---|---|---|
| 2,197,916 | 4/1940 | Balfe | 428/608 |
| 2,691,815 | 10/1954 | Boessenkool et al. | 228/117 |
| 3,057,481 | 10/1962 | Pall | 428/608 |
| 3,136,037 | 6/1964 | Solnick et al. | 228/117 |
| 3,437,457 | 4/1969 | Fisher | 428/608 |
| 3,620,880 | 11/1971 | Lemelson | 228/117 |
| 3,948,295 | 4/1976 | Lemont et al. | 428/608 |
| 4,269,882 | 5/1981 | Carrillo et al. | 181/292 |
| 4,433,021 | 2/1984 | Riel | 181/292 |
| 4,539,244 | 9/1985 | Beggs et al. | 181/292 |

*Primary Examiner*—Kenneth J. Ramsey
*Assistant Examiner*—Samuel M. Heinrich
*Attorney, Agent, or Firm*—Young & Thompson

[57] ABSTRACT

A porous metallic material of the present invention is constructed of a laminate consisting of an expanded metal and a fibrous metallic fiber both of which are pressed to be joined to each other under pressure. This porous metallic material is excellent in bending strength and workability. The porous metallic material may be laminated to a honeycomb structural element and a rigid plate so as to form a porous structural material. To this porous metallic material may be also laminated a decorative layer so as to form a porous decorative sound absorbing material. The present invention provides the above-mentioned products and method for manufacturing the same.

6 Claims, 13 Drawing Sheets

POROUS METALLIC MATERIAL, POROUS STRUCTURAL MATERIAL AND POROUS DECORATIVE SOUND ABSORBING MATERIAL, AND METHODS FOR MANUFACTURING THE SAME

This application is a division of application Ser. No. 048,667, filed May 11, 1987.

BACKGROUND OF THE INVENTION

1. Field of the Invention

The present invention relates to a porous metallic material, a porous structural material and a porous decorative sound absorbing material and methods for manufacturing the same, which materials are employed as a sound absorbing member, a catalyst and a building member and excellent in workability, cost, corrosion resistance and decorativeness in appearance, in addition to an excellent sound-absorbing properties thereof.

2. Description of the Prior Art

Hitherto, a porous metallic material is generally produced by a sintering process of a metallic powder or a foaming process of a molten metal. However, the thus produced conventional porous material is a molded product having been molded in a container such as a mold and the like, so that it is poor in workability during bending and the like.

Further, in case that the metallic powder is sintered to form a porous product, a troublesome consideration is required as to an ambient atmospheric condition of a sintering process for the porous product, because it is necessary to mix a low-melting material with the metallic powder before sintering in order to give the thus sintered product a porosity.

On the other hand, hitherto, various types of sound absorbing materials have been employed, which materials are generally classified into three types, that is, a fibrous material such as a glass-wool and the like; a sintered material such as a sintered metal or ceramic; and a concrete material.

It is necessary that the sound absorbing material is excellent in any of sound-absorbing efficiency, sound penetration loss, air-permeability, fire resistance and structural strength. The fibrous material such as the glass-wool and the like is poor in formability and is apt to extremely deteriorate in its sound absorbing efficiency when subjected to a rainy conditon. On the other hand, the sintered material such as the ceramic and the like is poor in impact strength while suffering from its large weight.

Consequently, there is a strong need for a porous metallic material which is excellent in sound absorbing properties and light in weight while provided with a sufficient mechanical strength.

However, in case that the porous metallic material is employed as a sound absorbing material, there are involved the following problems:

Since a porous metallic material having a thickness of from 1 to 2 mm does not serve as a sound absorbing material when it is brought into a rigidly close contact with a rigid body such as a sound-pressure source of an office automation instrument and like instruments, it is necessary to provide a certain air gap between such thin porous metallic material and the rigid body. In order to provide such air gap, channel members or stud members for supporting the porous metallic material are required. In this case, the more the spacing of such members increases, the more the impact absorbing capacity of a structure constructed of the porous metallic material and such members increases. On the other hand, a decrease of the spacing of such members causes the production cost of the structure to be increased, and worsens the structure at its portions adjacent to such channel members or stud members in its impact-absorbing capacity, air-permeability and sound absorbing efficiency.

In addition, in recent years, the field of application of the sound absorbing material has expanded. As a result, the sound absorbing material is widely employed in fields of building materials, office automation instruments and the like, in such fields a decorativeness in appearance is now required of the sound absorbing material.

In order to satisfy the above requirement, a color painting is applied to some conventional porous metallic material. However, such painting gives a surface of the porous metallic material a mottled appearance in color, because pores are not uniformly dispersed in the porous metallic material to lead to different pickup of a painting liquid in the pores under their capillary actions.

Further, the porous metallic material deteriorates its air-permeability when a surface thereof is covered with a plate made of a resin and the like.

On the other hand, there is another conventional material provided with a decoration, which material is constructed of a carpet member or a metallic member for an automobile use, in which member an organic fiber is planted according to a recently advanced fiber planting technique. In case that such fiber planting technique of the organic fiber is applied to a fiber planting treatment of a surface of the porous metallic material, there is a fear that the pores of the porous metallic material are closed with an adhesive applied in its application process which is employed as a pretreatment of the fiber planting treatment.

As described above, in the present state, there is substantially not provided a porous metallic material which is provided with a decorativeness without deteriorating its sound absorbing properties.

OBJECTS OF THE INVENTION

It is the first object of the present invention to provide a porous metallic material and a method for manufacturing the same, which material is excellent in workability and low cost and can be formed into a wide and elongated product.

It is the second object of the present invention to provide a porous structural material and a method for manufacturing the same, which material is excellent in sound absorbing efficiency, air-permeability, fire resistance and structural strength and light in weight so that it can be widely employed as a sound absorbing material in a building construction and like constructions.

It is the third object of the present invention to provide a porous sound absorbing metallic material which is excellent in decorativeness without deteriorating its sound absorbing properties.

DESCRIPTION OF THE PREFERRED EMBODIMENTS

Figure 1:
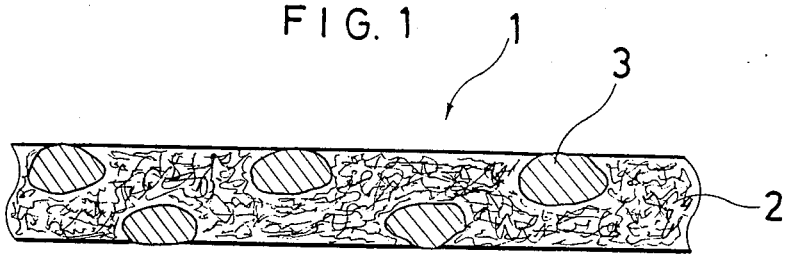
FIG. 1 is a cross sectional view of an embodiment of a porous metallic material of the present invention.
Figure 2:
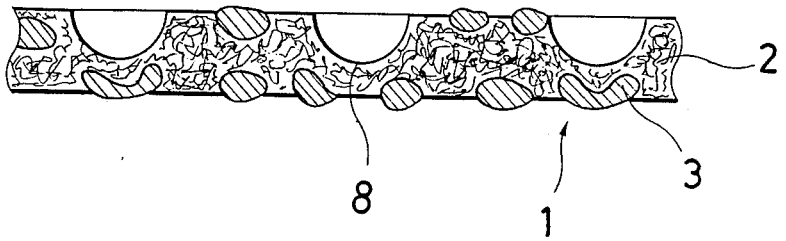
FIG. 2 is a cross sectional view of another embodiment of the porous metallic material of the present invention.

The present invention will be hereinbelow described in detail with reference to the drawings in which: the reference numeral 1 denotes a porous metallic material; 2 a metallic-fiber layer; 3 an expanded metal; 4 an interposed structural element constructed of a honeycomb material; 5 a rigid plate; 6 a decorative layer; 7 a twisted portion; 8 a partially compressed portion; 9 a double-faced adhesive tape; 10 an adhesive sheet; 11 a concrete floor; 12 a porous sintered aluminum plate; 13 a loudspeaker; 14 a microphone; 15 a test specimen; 16 an organic fiber planting layer; 17 an air gap; 18 a screw; 19 a sound absorbing space; 20 a porous structural material; 21 a convex portion; 22 a concave portion; and 30 a porous decorative sound absorbing material.

Now described are: (a) an expanded metal; (b) a metallic fiber; (c) an interposed structural element; (d) a rigid plate; and (e) a decorative layer; which are constituent elements of: (1) a porous metallic material; (2) a sound absorbing structural element (3) a porous structural material; and (4 a porous decorative sound absorbing material; of the present invention:

(a) The Expanded metal

Figure 3:
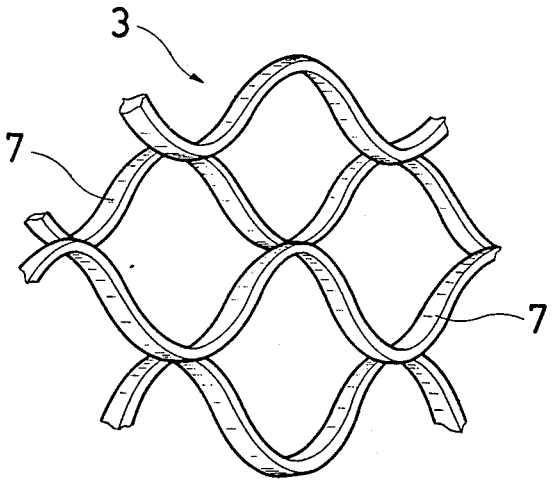
FIG. 3 is a perspective view of an expanded metal employed in the porous metallic material of the present invention.

The expanded metal 3 employed in the present invention is a so-called lath network or a punching metal as shown in FIG. 3 in perspective view, and is produced by providing a plurality of notches in a thin metallic plate to pull the same in a direction substantially perpendicular to a direction parallel to these notches so as to form a network or latticework. Since the thus formed expanded metal 3 is not a woven product of metallic wires such as a metal wire network, notching sections of the metallic plate are twisted in the pulling operation of the metallic plate to form twisted portions 7 of the expanded metal 3, each of which portions 7 is deviated in any of a direction perpendicular to a surface of the thin metallic plate, a direction parallel to such surface and a direction oblique to such surface. The deviations of the thus twisted portions 7 strengthen an engagement between the expanded metal 3 and a metallic-fiber layer 2 (shown in FIG. 1) which is superimposed on the expanded metal 3 under pressure. The present invention utilizes such configuration of the expanded metal 3 for constructing a porous metallic material.

The expanded metal 3 may be made of any metal, and preferably made of aluminum, copper, stainless steel, normal steel and the like.

The expanded metal 3 is not limited in thickness, and preferably has a thickness of from 0.2 to 1 mm.

Extents of the notching and the pulling operations of the thin metallic plate for forming the expanded metal 3 can be adjusted according to the configuration of the metallic-fiber layer 2 and its kind described later so as to obtain a porous metallic material 1 in which the expanded metal 3 is firmly joined to the metallic-fiber layer 2 under pressure.

(b) The metallic fiber

The metallic fiber employed in the metallic-fiber layer 2 accoring to the present invention substantially is a metallic strip such as a fibrous metal assuming in its cross section any desirable shape such as a triangular shape, a circular shape and the like having its effective diameter of substantially from 20 to 200 microns and a length of from 1 to 20 cm.

For example, there are methods for manufacturing the metallic fiber as follows:

(1) a machine-work method according to a wire drawing process; and (2) a spinning method for a molten metal.

In manufacturing the metallic fiber, any metallic material can be employed so that the material of the metallic fiber is determined according to the application field of the porous metallic material of the present invention. In such application field, for example, it is possible to employ: nickel for a fuel cell use; aluminum for a sound absorbing material use; stainless steel for a filtering medium use; and various metals and alloys thereof for a catalyst use.

Particularly, in case that an aluminum fiber spun from a molten aluminum-base metal serves as the metallic fiber employed in a sound absorbing material according to the present invention, since the thus spun fiber is fine and sufficiently flexible to enhance its engagement with the expanded metal, there is no fear that a fine metallic dust is produced in forming processes such as a bending process and the like processes of the metallic fiber, so that the metallic fiber is safe in environmental health.

(c) The interposed structural element

Figure 6:
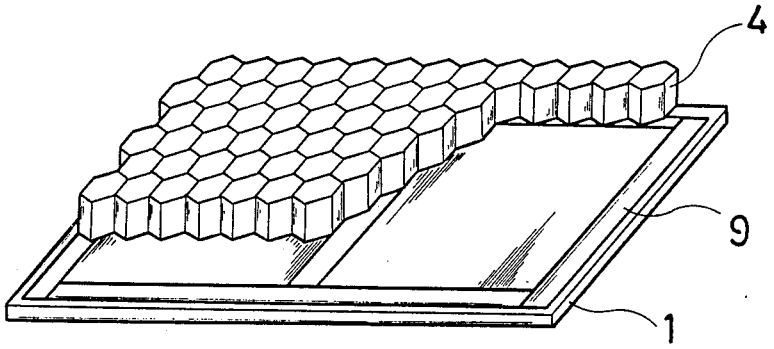
FIG. 6 is a perspective schematic view for illustrating a method for manufacturing the porous structural material of the present invention.

The interposed structural element 4 may have any construction, provided that a tubular communication-hole is provided in the interior of the interposed structural element 4. In general, as shown in FIG. 6, the interposed structural element 4 may be constructed of a so-called honeycomb member which has a very large mechanical strength as is already well known. The tubular communication-hole may assumes in its cross section any of polygonal shapes such as a triangular shape, in addition to a circular shape and an ellipsoidal shape.

(d) The rigid plate

Figure 5:
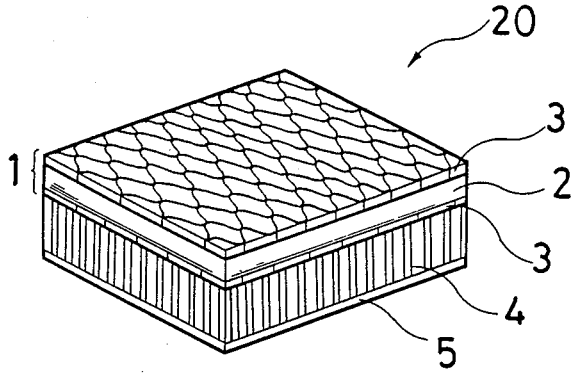
FIG. 5 is a perspective view of a porous structural material of the present invention.

As shown in FIG. 5, the rigid plate 5 may have any construction, and is preferably constructed of a rigid plate-like element, for example such as a steel plate, aluminum plate, concrete plate, synthetic-resin plate, wood board and the like.

(e) The decorative layer

Figure 16:
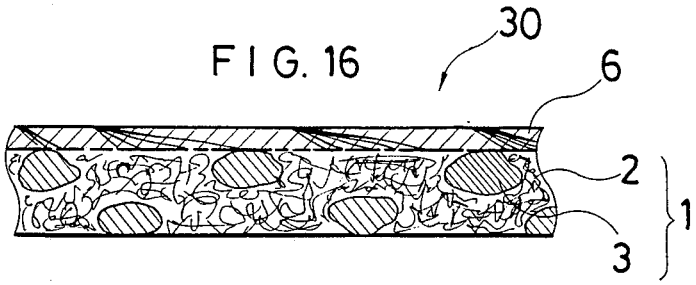
FIG. 16 is a cross sectional view of an embodiment of the present invention.

As shown in FIG. 16, the decorative layer 6 is preferably constructed of a cloth, a veneer, a cork veneer, the organic fiber planting layer 16 or the like in accordance with the use of the porous decorative sound absorbing material in which the decorative layer 6 is employed.

Figure 17:
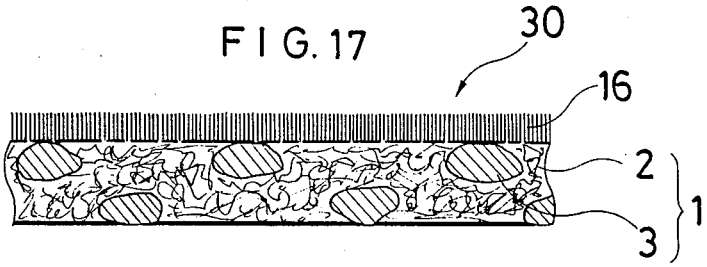
FIG. 17 is a cross sectional view of another embodiment of the present invention.

As shown in FIG. 17, the organic fiber planting layer 16 is constructed of an organic fiber planted in the metallic-fiber layer 2.

The organic fiber is preferably a short fiber having a diameter of from 20 to 60 microns and a length of from 1 to 5 mm, and planted in a condition of an applied voltage of 40 KV with a current of 0.1 mA.

It is preferable that such short fiber is fire-resistant or non-combustible. An acrylic fiber or a nylon fiber is non-combustible. An acrylic fiber or a nylon fiber is non-combustible in comparison with a normal short fiber, for example such as a polyester fiber and the like. In addition, in case that the metallic-fiber layer 2 is made of aluminum, since aluminum is excellent in thermal conductivity, the organic-fiber planting layer 16 constructed of the metallic-fiber layer 2 and the acrylic fiber or the nylon fiber is excellent in fire-protection properties. In the organic-fiber layer 16, it is also possible to employ a short fiber spun from a molten phenol-formaldehyde resin in place of the acrylic fiber or the nylon fiber.

Now, the materials of the present invention constructed of the above-mentioned constituent elements and the methods for manufacturing such materials will be described.

(1) The porous metallic material

As shown in FIG. 1, the porous metallic material 1 is produced as follows with the use of the expanded metal or metallic network and the metallic fiber.

Hereinbelow, as an example, the porous metallic material 1 constructed of an aluminum-base expanded metal and an aluminum fiber will be described. In addition to aluminum, it is also possible to employ any other metal as a material for the expanded metal and the metallic fiber, provided that such metal is suitable for their use.

Preferably, the metallic-fiber layer 2 is constructed of a non-woven product having a surface density of from 500 to 3000 g/m$^2$ and formed from the aluminum fiber.

Over at least one of opposite surfaces of such nonwoven product formed from the aluminum fiber is superimposed the aluminum-base expanded metal to form a laminate thereof, which laminate is then subjected to a pressing process or a rolling process under a pressure of from 300 to 2000 Kg/cm$^2$.

The aluminum fiber has a diameter of from 70 to 250 microns and a tensile strength of approximately 25 Kg/mm$^2$ in mean value with a stretch of from 10 to 20%. Consequently, the expanded metal is brought into a firmly engaging condition with respect to the almuminum metallic-fiber layer after the laminate thereof is subjected to the pressing process or the rolling process.

Since the aluminum fiber has the stretch of from 10 to 20% and little elastic strain due to its easiness in plastic deformation, it is practically deformed in an easy manner without producing substantially any elastic deformation thereof. On the other hand, since the aluminum-base expanded metal is formed by expanding a cold-rolled aluminum plate having been partially notched, the tensile strength of the thus formed expanded metal increases to an amount of approximately from 50 to 70 Kg/mm$^2$. Consequently, such aluminum expanded metal is firmly joined to the aluminum metallic fiber when subjected to a compressive action and a shearing stress.

It is possible to laminate the expanded metal 3 to opposite surfaces of the metallic-fiber layer 2 so as to form a laminated element thereof. It is also possible to laminate the metallic-fiber layer 2 to at least one of opposite surfaces of the expanded metal so as to form another laminated element.

It is also possible that one of the opposite surfaces of the metallic-fiber layer 2 is laminated with the expanded metal while the other surface thereof is laminated with a metallic network.

In addition, in the pressing or rolling process of the thus formed laminated element, when a roll provided with a surface projection is employed, the laminated element is partially subjected to a strong compressive action to form the partially compressed portion 8 according to a partially compressing process. As a result, the thus compressed laminated element has a large bonding strength.

The surface projection provided in the roll preferably assumes a spherical shape or an ellipsoidal shape having an effective diameter of from 1 to 2 mm. A plurality of the surface projecctions are preferably provided in the surface of the roll in a ratio of from 1 to 2 cm$^2$ per 10 cm$^2$ of the surface of the roll.

In such pressing or rolling process of the laminated element, if necessary, the laminated element is heated to a temperature of from 400° to 550° C. so as to further improve the metallic-fiber layer 2 in its bonding properties.

In case that the porous metallic material 1 of the present invention is employed as a sound absorbing material, it is possible to optimize frequency characteristics of the porous metallic material 1 so as to improve a sound absorbing efficiency thereof, provided that the metallic-fiber layer 2 and the expanded metal 3 or the metallic network are adequately selected and a rolling reduction in the rolling process is adequately selected as as to adequately adjust a density or porosity of the porous metallic material 1 which is a final product thus obtained.

(2) The sound absorbing structural element

Figure 21A:
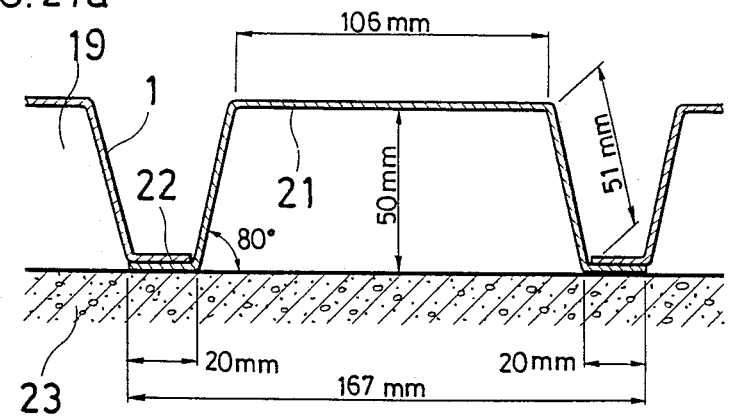
FIGS. 21*a*, 21*b* and 21*c* are cross sectional views of sound absorbing structural-members of the present invention, respectively.
Figure 21B:
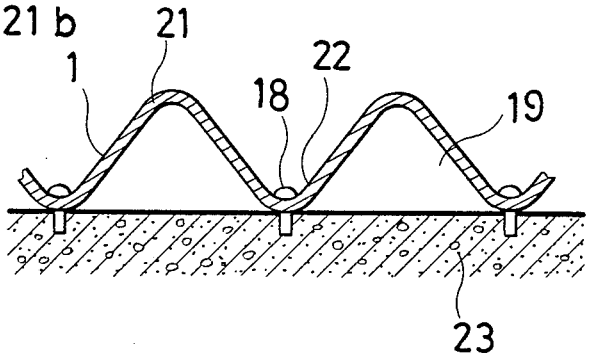
Figure 21C:
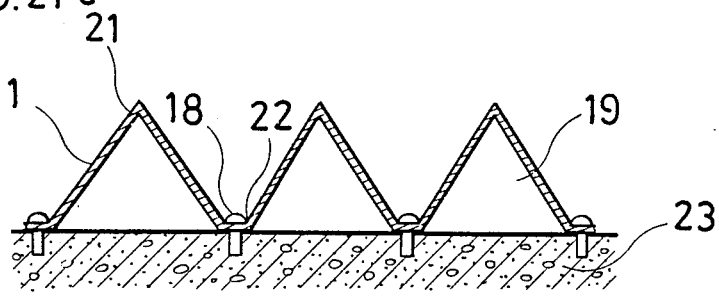

Preferred embodiments of the sound absorbing structural element employing the porous metallic material 1 described in the above item (1) are shown in FIGS. 21*a*, 21*b* and 21*c*.

The sound absorbing structural element of the present invention is constructed of the porous metallic material 1 having been shaped into a plate-like element which is provided with: a convex portion 21 having a large surface area, the interior of which convex portion 21 forms a sound absorbing space 19; and a concave portion 22 adapted for a mounting use.

Such sound absorbing structural element is easily formed through a conventional work such as a rolling work, a bending work and the like.

FIG. 21*a* shows a preferred embodiment of the sound absorbing structural element of the present invention, shaped into a so-called hat-like configuration provided with a trapezoidal convex portion 21 and an inverted trapezoidal concave portions 22, which convex portion 21 is provided with the sound absorbing space 19 defined between the convex portion 21 and a sound-barrier wall 23 on which concave portion 22 is mounted by means of a screw 18 (not shown in FIG. 21*a*) and like fastener means.

FIG. 21*b* shows another embodiment of the sound absorbing structural element of the present invention, in which embodiment both of the convex portion 21 and the concave portion 22 of the sound absorbing structural element are formed with a corrugated panel so that a crest portion thereof serves as the convex portion 21 provided with the sound absorbing space 19 defined between the crest portion and the sound-barrier wall 23, while a root portion of the corrugated panel serves as the concave portion 22 mounted on the sound-barrier wall 23 by means of the screw 18 and the like fastening means.

FIG. 21*c* shows further another embodiment of the sound absorbing structural element of the present invention, in which embodiment the convex portion 21 assumes a triangular shape while the concave portion 22 assumes an inverted trapezoidal shape.

In case that the sound absorbing structural element of the present invention has any one of the abovementioned constructions, it is possible to increase a sounnd-receiving area of the sound absorbing structural element so as to increase its sound absorbing space 19, whereby a sound absorbing efficiency of the sound absorbing structural element of the present invention is remarkably improved.

If necessary, it is possible to insert a soft porous material such as a glass-wool and the like into the sound absorbing space 19 defined between the convex portion 21 of the sound absorbing structural element and the sound-barrier wall 23 so as to improve a sound absorbing effect of the sound absorbing structural element of the present invention.

(3) The porous structural material

The porous structural material comprises the porous metallic material 1, the interposed structural element 4, and the rigid plate 5, and is integrally constructed of the same.

As shown in FIGS. 1, 5 and 6, the interposed structural element 4 is applied to one of opposite surfaces of the porous metallic material 1, which element 4 is provided with a plurality of tubular communication-holes arranged in parallel to each other in the interior of the interposed structural element 4. Consequently, each of the tubular communication-holes is communicated, at its one end, with the very fine pores of the porous metallic material 1, while closed, at its the other end, by the rigid plate 5 mounted on a back surface of the interposed structural element 4.

It is possible to integrally assemble the porous metallic material 1 and the interposed structural element 4 together with the rigid plate 5 through any desirable assembling processes of which the following ones are preferable:

1. As shown in FIG. 6, the double-faced adhesive tape 9 is sandwiched between the porous metallic material 1 and the interposed structural element 4 to integrally assemble them. In assembling, it is preferable that the double-faced adhesive tape 9 is partially sandwiched between the porous metallic material 1 and the interposed structural element 4 so as not to excessively close both of the communication-holes of the interposed structural element 4 and the pores of the porous metallic material 1.

The double-faced adhesive tape 9 is preferably constructed of a woven nylon cloth applied with a butyl rubber adhesive mass at its opposite surfaces, and has a thickness of 0.4 mm with a width of approximately 20 mm. The thus constructed double-faced adhesive excellent in weathering resistance. In addition, since the tape 9 has a sufficient thickness of 0.4 mm, it is possible that the interposed structural element 4 constructed of the honeycomb member enters the interior of the adhesive tape 9 so as to be firmly fixed thereto when the interposed structural element 4 is slightly pushed against the double-faced adhesive tape 9.

Figure 7:
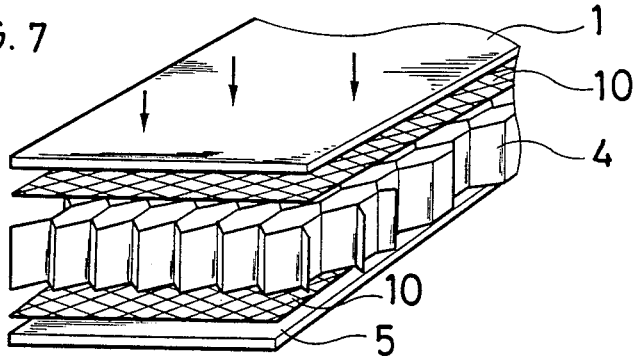
FIG. 7 is an exploded view of the porous structural material, for illustrating the method for manufacturing the same.

In general, since the porous metallic material 1 or sound absorbing material forms the sound-barrier wall having a large surface, the double-faced adhesive tape 9 applied to the porous metallic material 1 substantially does not deteriorate the sound absorbing effect of the porous metallic material 1 even when the tape 9 partially closes the pores of the porous metallic material 1. A preferably sandwiched area of the double-faced adhesive tape 9 is approximately 3% per 1 $m^2$ of the sound absorbing area of the porous metallic material 1; and 2. As shown in FIG. 7, a network-like adhesive sheet 10 is preferably sandwiched between the porous metallic material 1 and the interposed structural element 4 to form a laminate thereof, which laminate is then heated to form an integrally assembled product.

The material of the adhesive sheet 10 of such assembled product may be any of polyester resins, polyamide resins and ethylene-vinyl acetate resins (EVA resins). These materials or resins are selected according to the application field and the environmental condition in use of such integrally assembled product. For example, the polyamide resins are well known under the trade name "Nylon" and excellent in outdoor corrosion resistance, while they require a relatively high temperature within a range of from 130° to 150° C. as their adhesion temperature. On the other hand, both of the polyester resins and EVA resins require a relatively low temperature within a range of from 110° to 130° C. as their adhesion temperature.

Any types of the network-like adhesive sheet 10 may be employed. In this connection, as shown in FIGS. 8*a*, 8*b*, 8*c*, 8*d*, 8*e* and 8*f*, products of Toyo Rayon Kabushiki Kaisha in Japan are preferably employed as such network-like adhesive sheet 10, the mean thickness of which products are approximately within a range of from 0.1 to 0.2 mm. In addition to the above, the adhesive sheet 10 may be constructed of a non-woven cloth like material as shown in FIG. 8*g*. The adhesive sheet 10 may assume any shape, provided that the adhesive sheet 10 does not excessively close both of the communication-holes of the interposed structural element 4 and the pores of the porous metallic material 1 so as not to deteriorate the air-permeability of the integrally assembled element thereof after the adhesive sheet 10 is subjected to its heating/bonding process for integrally assembling them. Consequently, since the air-permeability of the thus integrally assembled element is substantially not deteriorated as described above, such assembled element or porous structural material is excellent in sound absorbing properties.

Adhesion conditions of the porous structural material are, for example, as follows:

adhesion time 15 seconds;

adhesion temperature: 80° to 150° C.; and adhesion pressure 0.2 to 0.5 Kg/cm$^2$.

Any process may be employed to join the interposed structural element 4 to the rigid plate 5. They can be joined to each other in the same process as that employed in joining the interposed structural element 4 to the porous metallic material 1, or joined to each other in another process different from the above process.

(4) The porous decorative sound absorbing material

As shown in FIG. 16, in the porous decorative sound absorbing material 30, the decorative layer 6 constructed of a cloth, a veneer, a cork veneer, an organic-fiber planting layer or the like is bonded to the porous metallic material 1 through an adhesive without deteriorating the porosity of the porous metallic material 1.

In this case, any types of the adhesive may be employed, and a preferable type of the adhesive is made of: thermoplastic resins such as acrylic resins, epoxy resins and the like; or thermoset resins such as urea resins, polyester resins and the like.

The adhesive may be applied through a suitable process such as a spraying process, spread coating process and like application-processes. In addition, it is also possible to apply the adhesive by means of a web-like or network-like laminated sheet such as the network-like adhesive sheet 10 decsribed in the above item (3) with regard to the porous structural material.

Since it is necessary to prevent the pores of the porous metallic material 1 from being excessively closed by the adhesive, the adhesive is preferably dissolved into a suitable solvent and then applied through the spraying process.

By effectively utilizing the irregularities or concave/-convex portions of the surface of the porous metallic material 1, it is possible to apply the adhesive to the surfaces of the convex portions of such irregularities only, so as to provide the decorative layer 6 in the porous decorative sound absorbing material 30 without closing the pores of the porous metallic material 1.

In case that the web-like or network-like laminated sheet is employed, such sheet is preferably superimposed over the surface of the porous metallic material 1 and bonded thereto by means of a hot-melt adhesive.

Since the porous decorative sound absorbing material 30 is provided with the decorative layer 6, it is possible to adjust the sound absorbing efficiency of the sound absorbing material 30 by adequately selecting in material the decorative layer 6 being bonded to the porous metallic material 1 even if the same porous metallic material 1 is poor in flow resistance. In this connection, it is important that the decorative layer 6 being bonded to the porous metallic material 1 to form the porous decorative sound absorbing material 30 enhances the decorativeness of the thus formed porous decorative sound absorbing material 30 and makes it possible to employ the sound absorbing material 30 as a decorative item.

The present invention will be further described hereinbelow in detail with reference to its embodiments:

EMBODIMENT 1

With the use of the aluminum metallic fiber and the aluminum expanded metal both of which are shown in Table 1, the porous metallic material of Embodiment 1 is manufactured:

Manufacturing conditons

In notching process of the expanded metal, a feed rate of the metallic plate having a thickness of 0.4 mm is 1 mm.

An employed aluminum metallic fiber is made of an aluminum-base alloy comprising by weight: 0.5% of magnesium; 0.4% of silicon; and the remainder being substantially aluminum. Such metallic fiber is spun from the molten aluminum-base alloy into a filament having a diameter of 100 microns, and is formed into a non-woven cloth. The non-woven cloth made of aluminum fiber is sandwiched between a pair of expanded metals to form a laminate, which laminate is subjected to a rolling press under pressure of 500 Kg/cm$^2$. Then a pressure of 1.5 ton/cm$^2$ is applied to the partially compressed portion of such laminate through the partially compressing process.

In the Embodiment 1, in order to improve the sound absorbing efficiency of the Embodiment 1, openings of the expanded metal are shaped into suitable configurations in accordance with the surface density of the aluminum-base non-woven cloth.

The following tests are conducted with regard to the thus obtained porous metallic material 1, and the results of such tests are shown in Table 2:

(1) Bend Test

The bend test is conducted according to a method of a bend test defined in JIS-Z-2248, in which method a test specimen is bent so that its inside radius or bend angle attains a specified value, and then the existence of defects such as fissures or the like is examined.

(2) Peeling-resistance test

The test specimen has a width of 10 cm and a length of 20 cm. A part of an expanded metal of the test specimen is peeled to the extent of a length of 10 cm to form a single-overlapping portion which is caught and pulled by a test machine to conduct a shear test serving as the peeling-resistance test of the test specimen.

Figure 4:
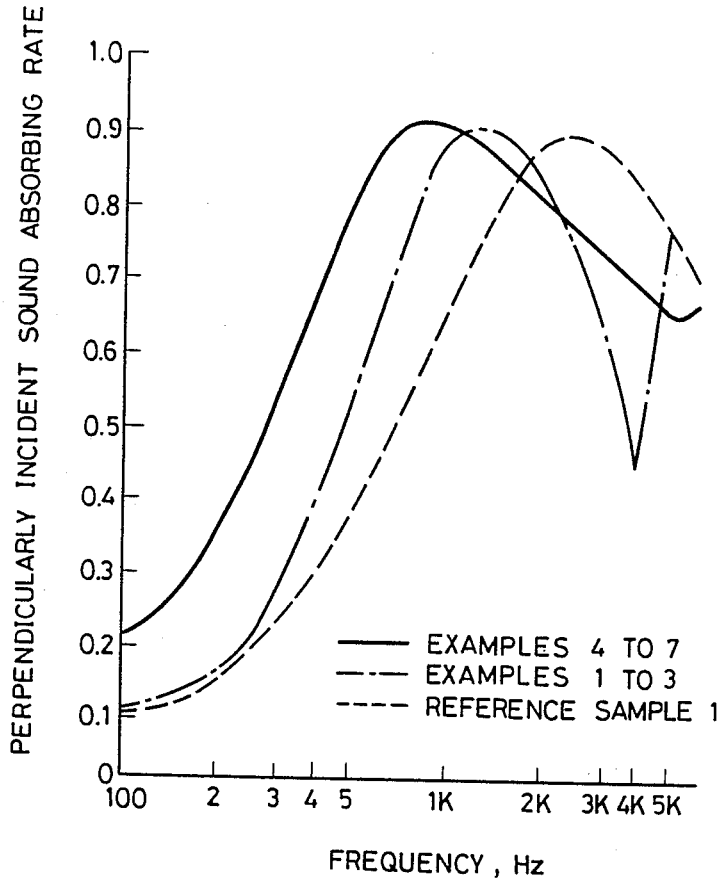
FIG. 4 is a diagram illustrating a relationship between a perpendicularly incident sound absorbing rate and a frequency of a sound received in the porous metallic material of the present invention.

Further, the perpendicularly incident sound absorbing rates of Examples 1 to 7 of the Embodiment 1 are measured and shown in FIG. 4 with respect to the frequency of the sound being measured. These measurements are conducted according to the perpendicularly incident sound absorbing rate measuring method of building materials defined in JIS 1405-1963.

REFERENCE SAMPLE 1

The reference sample 1 is a porous sintered plate having the same size as that of the Embodiment 1, as shown in the Table 1, and subjected to the same tests as those imposed on the Embodiment 1. The results thereof are also shown in the Table 2 and FIG. 4.

TABLE 1

| | ALUMINUM FIBER'S Surface DENSITY ($g/m^2$) | EXPANDED METAL'S OPENINGS SIZE (mm) | LAMINATE |
|---|---|---|---|
| EXAMPLE 1 | 550 | 3 × 2 | METALLIC FIBER SANDWICHED BETWEEN EXPANDED METALS |
| EXAMPLE 2 | 550 | 3 × 2 | THE SAME AS ABOVE |
| EXAMPLE 3 | 550 | 3 × 2 | THE SAME AS ABOVE |
| EXAMPLE 4 | 1100 | 4 × 3 | THE SAME AS ABOVE |
| EXAMPLE 5 | 1100 | 4 × 3 | THE SAME AS ABOVE |
| EXAMPLE 6 | 1100 | 4 × 3 | METALLIC FIBER SANDWICHED BETWEEN ALUMINUM NETWORK AND EXPANDED METAL |
| EXAMPLE 7 | 1100 | 4 × 3 | THE SAME AS ABOVE |
| REFERENCE SAMPLE 1 | ALUMINUM POWDER | — | — |

| | JOINING CONDITION UNDER PRESSURE | THICKNESS OF POROUS ELEMENT (mm) | POROSITY (%) |
|---|---|---|---|
| EXAMPLE 1 | | 1.5 | 43 |
| EXAMPLE 2 | PARTIAL COMPRESSION | 1.5 | 43 |
| EXAMPLE 3 | AFTER PARTIAL COMPRESSION, HEATING AT 550° C. FOR ONE HOUR IN $N_2$—GAS, DEW POINT −20° C. | 1.5 | 43 |
| EXAMPLE 4 | | 1.6 | 45 |
| EXAMPLE 5 | PARTIAL COMPRESSION | 1.6 | 44 |
| EXAMPLE 6 | PARTIAL COMPRESSION | 1.6 | 44 |
| EXAMPLE 7 | AFTER PARTIAL COMPRESSION, HEATING AT 550° C. FOR ONE HOUR IN $N_2$—GAS, DEW POINT −20° C. | 1.6 | 44 |
| REFERENCE SAMPLE 1 | | 1.5 | 44 |

TABLE 2

| | BEND TEST | PEELING-RESISTANCE, TENSILE SHEAR STRENGTH ($Kg/cm^2$) | PERPENDICULARLY INCIDENT SOUND ABSORBING RATE |
|---|---|---|---|
| EXAMPLE 1 | NO CRACK | 35 | SEE A DIAGRAM SHOWN IN FIG. 4 |
| EXAMPLE 2 | NO CRACK | 70 | |
| EXAMPLE 3 | NO CRACK | 150 | |
| EXAMPLE 4 | NO CRACK | 41 | |
| EXAMPLE 5 | NO CRACK | 80 | |
| EXAMPLE 6 | NO CRACK | 80 | |
| EXAMPLE 7 | NO CRACK | 170 | |
| REFERENCE SAMPLE 1 | CRACK APPEARS AT 15° | NON-MEASURABLE | |

On the basis of the Table 2, it is found that:

Since the Examples 1 and 4 of the present invention are provided with the large joining area, they are favorable for the use of the sound-barrier wall of which a large adhesion force or peeling resistance is not required. On the other hand, the Examples 2, 5 and 6 of the present invention produced by the partially compressing process are favorable for the use of a product which is subjected to an external force such as vibration and like forces to make it necessary that such product has a large adhesion force. For the use of another product of which a larger adhesion force is required, the Examples 3 and 7 of the present invention are favorable, because these Examples 3 and 7 are provided with highly-compressed dense portions being subjected to the heating treatment so as to form the porous metallic materials according to the methods of the present invention.

EMBODIMENT 2

The evaluation of the porous structural material of the present invention is made through the following experiments:

Experiment 1

The following test specimens are prepared in order to compare the Embodiment 2 of the present invention having the aluminum honeycomb with the reference samples not having the aluminum honeycomb as to the sound penetration loss, provided that each of the above test specimens is shaped into a piece having a size of 500×500 mm:

(i) Reference Sample 2

An aluminum plate having a thickness of 1.2 mm;

(ii) Reference Sample 3

A laminate constructed of: a 0.6 mm aluminum plate—a 20 mm aluminum honeycomb—a 0.6 mm aluminum plate;

(iii) Example 8 of the Embodiment 2

A laminate constructed of: a 0.6 mm porous metallic material "A"; a 20 mm aluminum honeycomb; and a 0.6 mm aluminum plate;

(iv) Reference Sample 4

A laminate constructed of: a 0.6 mm porous metallic material "A"; a 20 mm paper honeycomb; and a 0.6 mm aluminum plate; wherein: a cell size of the honeycomb is 10 mm; and the porous metallic material "A" is constructed of an aluminum non-woven cloth and expanded metals.

Figure 9:
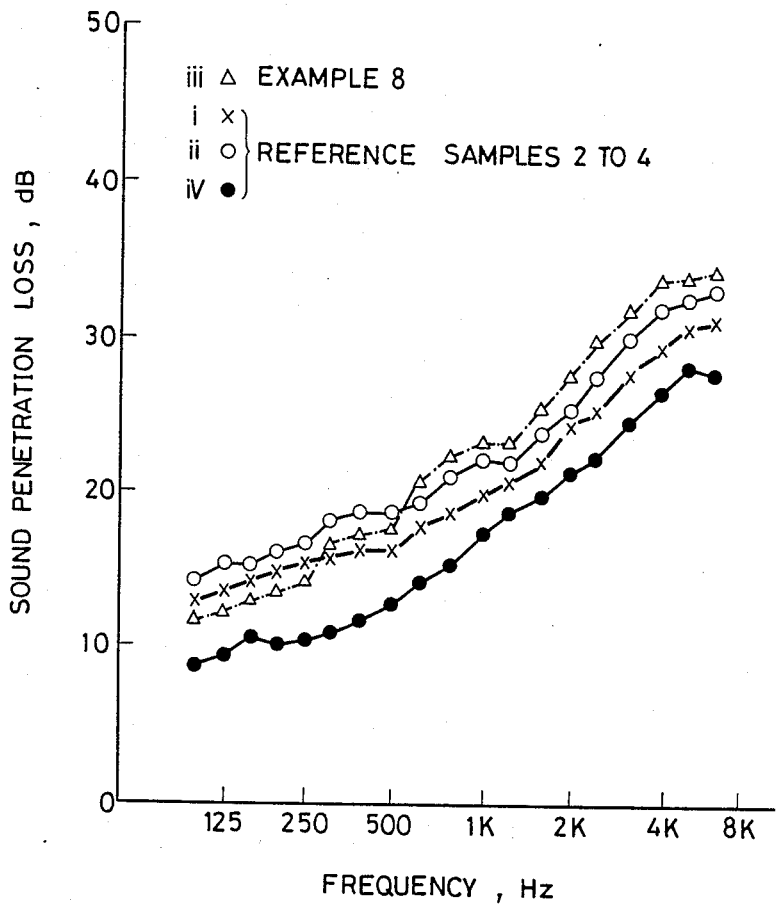
FIGS. 9 to 12 are diagrams illustrating measurement results of examples of the present invention and reference samples, respectively.

As a result of the above Experiment 1, a diagram shown in FIG. 9 is obtained as to the sound penetration loss of the test specimens defined in the above items (i), (ii), (iii), and (iv)

As is clear from FIG. 9, with regard to the sound penetration loss shown therein, one of the test specimens, i.e., the Reference sample 3 marked with a symbol "O" is larger than the Reference sample 2 marked with a symbol "x", over the full range of the frequency shown in FIG. 9. However, the Example 8 of the present invention marked with a symbol "Δ" is further larger than such Réference sample 3, particularly in a high range of the frequency. In this connection, it is considered that the sound penetration loss has a large effect on the sound absorbing effect of the test specimens.

As a result of the above, it is found that the test specimen having the honeycomb is larger in the sound penetration loss than the test specimen not having the honeycomb, provided that these test specimens are the same in thickness.

In comparing the Reference sample 2 with the Reference sample 3; and the Example 8 of the present invention with the Reference sample 4 which is marked with a symbol ".", it is found that the test specimen covered with the porous material is not different in the sound penetration loss from the test specimen covered with the plate.

In comparing the Example 8 of the present invention with the Reference sample 4, it is found that the aluminum honeycomb is larger in the sound penetration loss than the paper honeycomb.

In comparing the Reference sample 3 with the Example 8 of the present invention, it is found that the porous metallic material is larger in the sound penetration loss than the aluminum plate.

Figure 14:
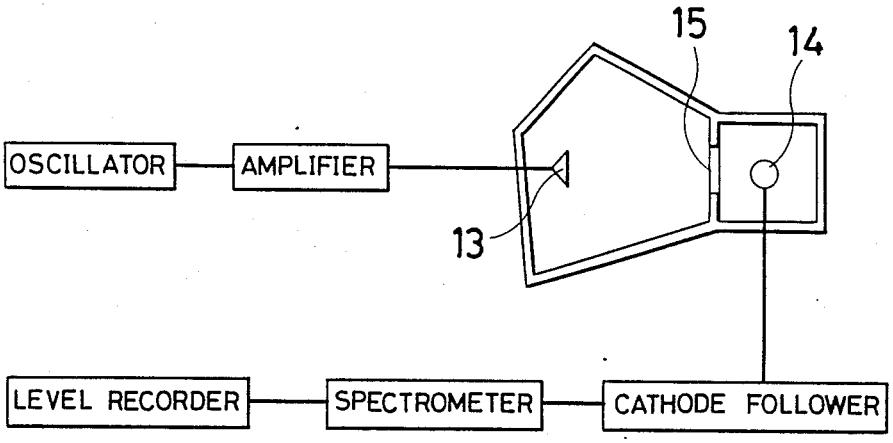
FIG. 14 is a schematic view illustrating a method for measuring a sound penetration loss.

Incidentally, the measurement of the sound penetration loss of the above test specimens are conducted according to a noise-reduction measuring method defined in ISO/R 140-1960, as shown in FIG. 14.

In this measurement, as shown in FIG. 14, the sound is issued from a loudspeaker 13 to the test specimen 15 so as to penetrate or pass through the same 15. The sound having passed through the test specimen 15 is then caught by a microphone 14 so as to be measured.

Figure 15:
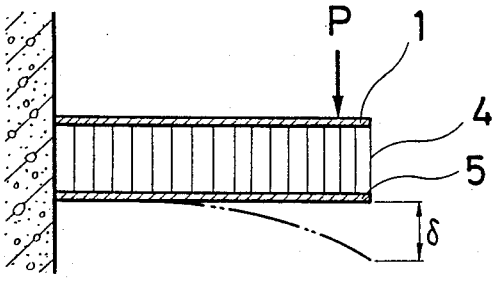
FIG. 15 is a schematic view illustrating a method for measuring a deflection of a cantilever beam under load.

In a cantilever condition shown in FIG. 15, each of the test specimens employed in the Experiment 1 is subjected to a concentrated loading test.

The following Table 3 is obtained by employing a concentrated load "P" of which an amount is 1 Kg or 2 Kg, which load "P" is applied to each of the test specimens in a manner as shown in FIG. 15 to measure the maximum deflection "67" of each of the test specimens.

TABLE 3

| | P = 1 Kg | P = 2 Kg |
|---|---|---|
| REFERENCE SAMPLE 2 | δ = 5 cm | δ = 13 cm |
| REFERENCE SAMPLE 3 | 0 | 0 |
| EXAMPLE 8 | 0 | 0 |
| REFERENCE SAMPLE 4 | 0 | 2 |

Experiment 2

Each of the test specimens or Examples of the present invention, in which the aluminum honeycomb is applied by the use of a double-faced adhesive tape, is compared with each of the test specimens or Reference samples with regard to the sound penetration loss, provided that each of the test specimens is shaped into a size of 500×500 mm.

(i) Reference Sample 5

A 2.6 mm aluminum plate;

(ii) Reference Sample 6

A laminate constructed of: a 0.6 mm aluminum plate; a 20 mm honeycomb; and a 2 mm aluminum plate;

(iii) Example 9 of the present invention

A laminate constructed of: a 2 mm aluminum non-woven cloth; aluminum expanded metals provided at both sides thereof, a 20 mm aluminum honeycomb; and a 0.6 mm aluminum plate with the double-faced adhesive tape;

(iv) Reference Sample 7

A laminate constructed of: a 2 mm aluminum non-woven cloth; aluminum expanded metals provided at both sides thereof, a 20 mm aluminum honeycomb; and a 0.6 mm aluminum plate without the double-faced adhesive tape; and (v) Reference Sample 8

A laminate constructed of: a 2 mm sintered aluminum plate; a 20 mm aluminum honeycomb; and a 0.6 mm aluminum plate with the double-faced adhesive tape.

A portion of any of the test specimens described above, through which portion passes the sound to be measured as to the measurement of the sound penetration loss, has a thickness of 2.6 mm.

In the above items (ii) to (v), a cell size of the honeycomb having a thickness of 0.1 mm is 10 mm. On the other hand, each of the aluminum non-woven cloth and the sintered plate both of which are employed in the porous aluminum structural element has a porosity of approximately 45%. Incidentally, the sintered plate employed in the test specimens has a thickness of 2 mm due to a difficulty of production of a sintered plate having a thickness of less than 2 mm.

Figure 10:
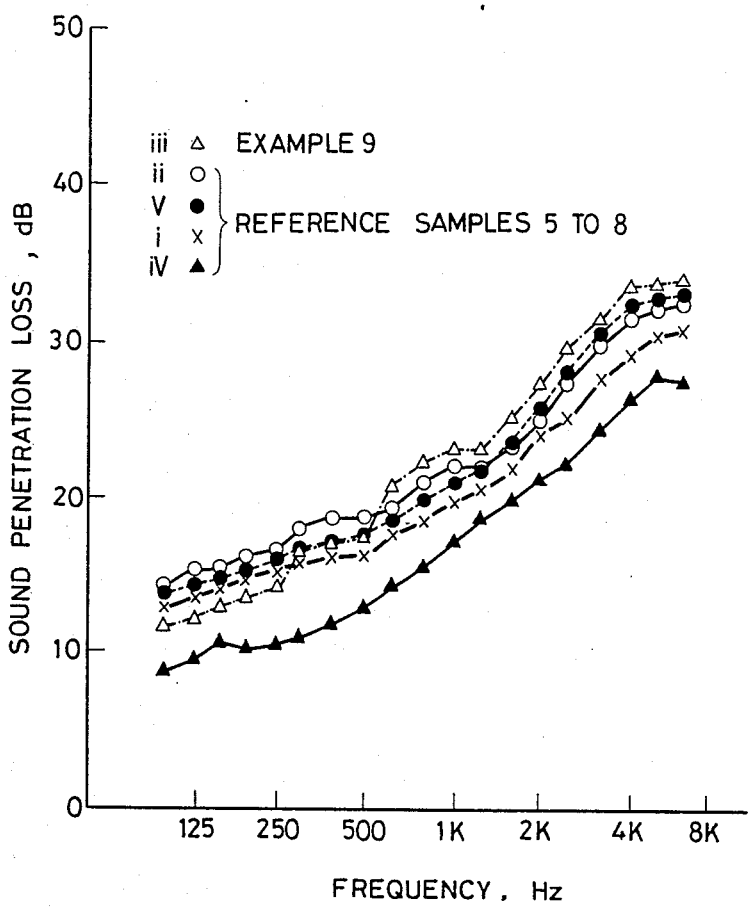

The measurement results of the above test specimens with regard to the sound penetration loss thereof are shown in FIG. 10 in which are marked: the Reference Sample 5 with a symbol "x"; the Reference Sample 6 with a symbol "O"; the Example 9 with a symbol "Δ"; the Reference Sample 7 with a symbol "▲"; and the Reference Sample 8 with a symbol ".".

As is clearly shown in FIG. 10, with regard to the sound penetration loss, the Reference Sample 6 marked with the symbol "O" is larger than the Reference Sample 5 marked with the symbol "x" over the full range of the frequency shown in FIG. 10. In a high range of the frequency, the Example 9 of the present invention marked with the symbol "Δ" is further larger than the Reference Sample 6. On the other hand, the Reference Sample 8 marked with the symbol "." is inferier, in sound-barrier properties, to the Example 9 of the present invention due to, probably, the existence of voids resulted from the irregularities of the aluminum powder.

In case that the test specimens are the same in thickness, the test specimen having the honeycomb be covered at its opposite sides is larger in the sound penetration loss than the test specimen not having the honeycomb be covered at its opposite sides. In case that the honeycomb is not firmly joined, the test specimen having such loose honeycomb is poor in sound-barrier properties.

Experiment 3

The test specimens having the aluminum honeycombs bonded in various adhesion manners are compared with each other with regard to the sound absorbing effect thereof, as follows:

(a) Example 10 of the present invention is constructed of: an aluminum honeycomb having a height of 20 mm, a cell size of 10 mm and a thickness of 0.1 mm; and a porous metallic material (an aluminum non-woven cloth, aluminum expanded metals at both sides thereof) having a thickness of 2 mm, a width of 50 cm and a porosity of 45%, which porous metallic material is bonded to the aluminum honeycomb through the double-faced adhesive tape;

(b) Reference sample 9 is constructed of: the aluminum honeycomb; and the porous metallic material provided that the porous metallic material is simply disposed on the surface of the aluminum honeycomb without employing the double-faced adhesive tape;

(c) Reference sample 10 is constructed of: a porous aluminum sintered plate having a thickness of 2 mm and a porosity of 45%; and the aluminum honeycomb bonded to such sintered plate through the double-faced adhesive tape;

(d) Reference sample 11 is constructed of: the porous metallic material simply spaced apart from a concrete floor to provide an air gap of 20 mm therebetween;

Both of the thus constructed Example 10 and Reference samples 9 to 11, i.e., the test specimens are subjected to a reverberation chamber test so as to determine the sound absorbing effects thereof.

Figure 11:
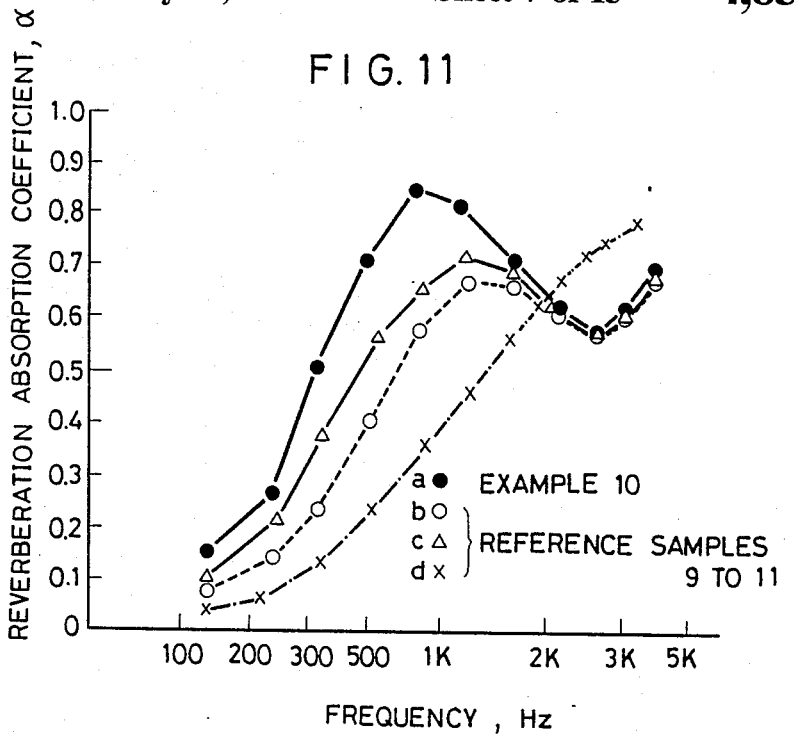
Figure 13A:
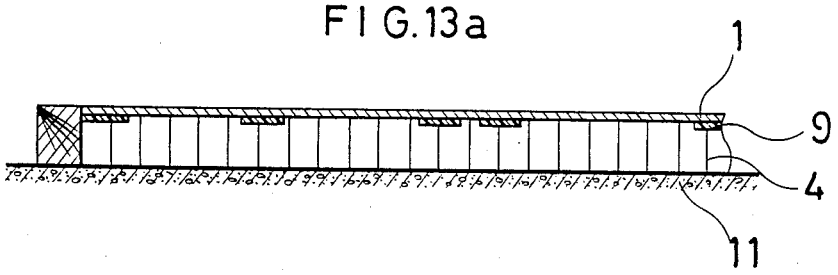
FIGS. 13*a*, 13*b*, 13*c* and 13*d* d are schematic views illustrating arrangements employed in a reverberation absorption test method, respectively.
Figure 13B:
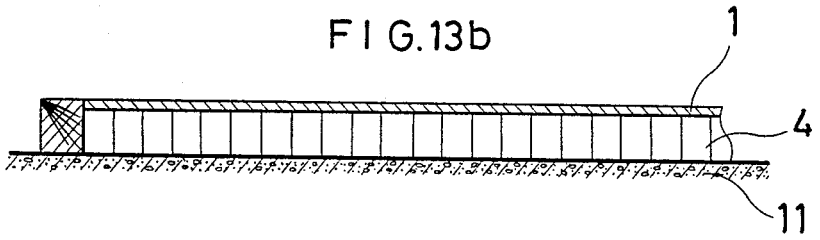
Figure 13C:
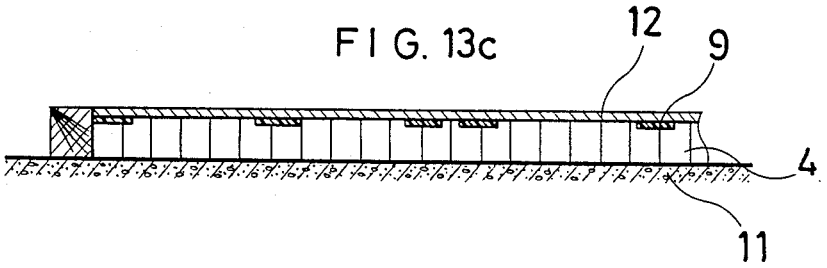
Figure 13D:
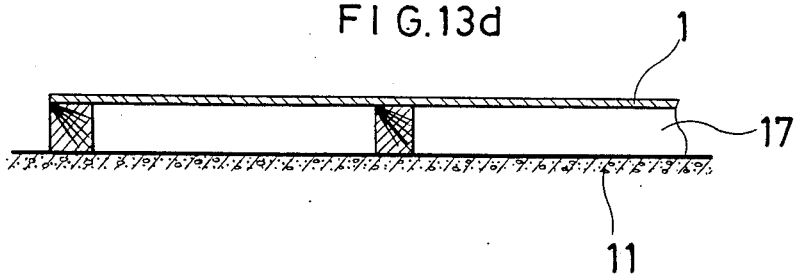

As shown in FIGS. 13*a*, 13*b*, 13*c* and 13*d*, in the reverberation chamber test, the honeycomb 4 shown in FIGS. 13*a*, 13*b* and 13*c* or the air gap 17 shown in FIG. 13*d* is interposed between the porous metallic material 1 shown in FIGS. 13*a*, 13*b* and 13*d* or the porous aluminum sintered plate 12 shown in FIG. 13*c* and a concrete floor 11, provided that each of the porous metallic material 1 and the porous aluminum sintered plate 12 is bonded by the use of the double-faced adhesive tape 9. The results of the reverberation chamber test of these test specimens are shown in FIG. 11.

The Reference sample 10 is slightly inferior, in sound absorbing effect, to the Example 10 of the present invention in spite of the honeycomb of the Reference sample 10 being bonded by the use of the double-faced adhesive tape. On the other hand, since the Reference sample 9 makes its porous aluminum plate be simply disposed on the honeycomb, such sample 9 is poor in sound absorbing properties.

Experiment 4

The porous metallic material having a porosity of 50 is prepared by hot-pressing an assembly of the aluminum non-woven cloth and the expanded metals both of which have been joined to each other in a superimposing manner under pressure applied thereto by a roll, provided that the hot-pressing is conducted at a temperature of 110° C. under a pressure of about 0.3 $Kg/cm^2$ for 10 seconds.

Figure 8A:
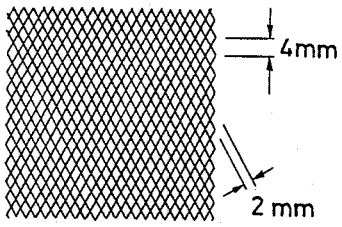
FIGS. 8*a*, 8*b*, 8*c*, 8*d*, 8*e*, 8*f* and 8*g* are schematic views of adhesive sheets employed in the present invention, respectively.
Figure 8B:
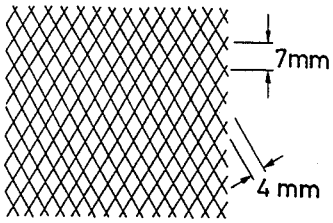
Figure 8C:
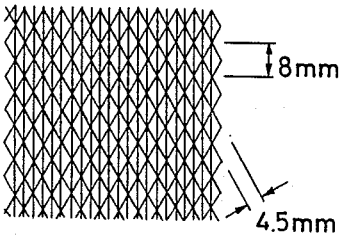
Figure 8D:
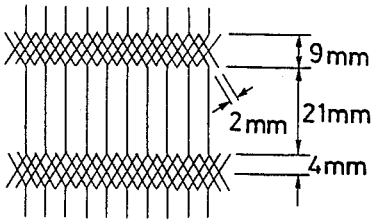
Figure 8E:
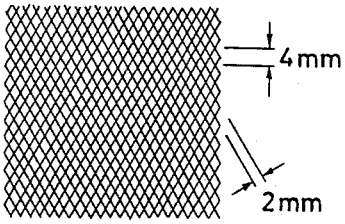
Figure 8F:
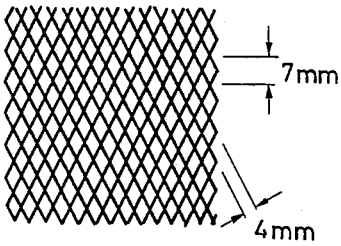
Figure 8G:
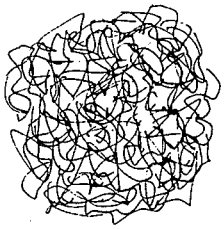

The thus prepared porous metallic material is laminated to an aluminum honeycomb having a cell size of 10 mm and a height of 30 mm with a web-like or network-like polyamide adhesive sheet having a thickness of 0.15 mm as shown in FIG. 8*f* interposed therebetween so as to prepare an assembly thereof, which assembly is then hot-pressed at a temperature of 150° C. under a pressure of 0.3 $Kg/cm^2$ for 20 seconds to prepare the porous structural material, i.e., Example 11 of the present invention. A peel strength of the thus prepared Example 11 is 160 g per 25 mm.

The above adhesion properties of the Example 11 is measured by the peel strength measurement test defined in JIS Z 0237. In this measurement, Tensilon UTM-4-100 type is employed as a measurement instrument, and operated at a stress rate of 50 mm/minute.

In the above hot-pressing, the web-like adhesive sheet is completely bonded to the aluminum honeycomb in spite of its small adhesion area. Namely, portions of the adhesive sheet not abutting on the aluminum honeycomb in the condition of the assembly are curled and welded to the surface of the aluminum honeycomb under the actions of heat and pressure applied thereto in the hot-pressing, so that the porosity of the Example 11 of the present invention is not impaired.

Figure 12:
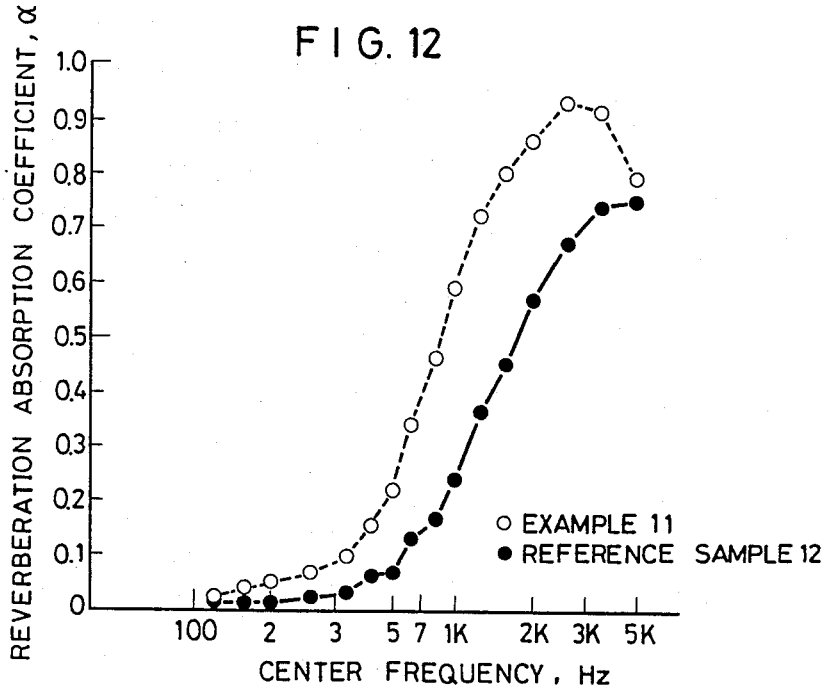

The reverberation absorption coefficient of the Example 11 is determined in the same method as that employed in the Experiment 3, i.e., determined according to the measurement method defined in JIS-A1409-1967. The thus obtained measurement results are shown in FIG. 12 in which Reference sample 12 is also shown. The Reference sample 12 is constructed of the porous metallic material provided with the air gap 17 an amount of which is 30 mm, while the Example 11 of the present invention is constructed of the porous aluminum metallic material and the honeycomb member together with the web-like adhesive sheet.

EMBODIMENT 3

In order to evaluate the properties of the porous decorative sound absorbing material of the present invention, the following experiments are conducted:

Experiment 5

A non-woven cloth made of aluminum fiber is sandwiched between a par of expanded metals to prepare Reference sample 13 which is a porous metallic material having an air-flow resistance of 68 g/sec $cm^3$ and a porosity of 60%. The Reference sample 13 is shaped into a test specimen having a thickness of 2.5 mm, the perpendicularly incident sound absorbing rate of which specimen is measured with the use of the air gap of 50 mm.

Figure 18:
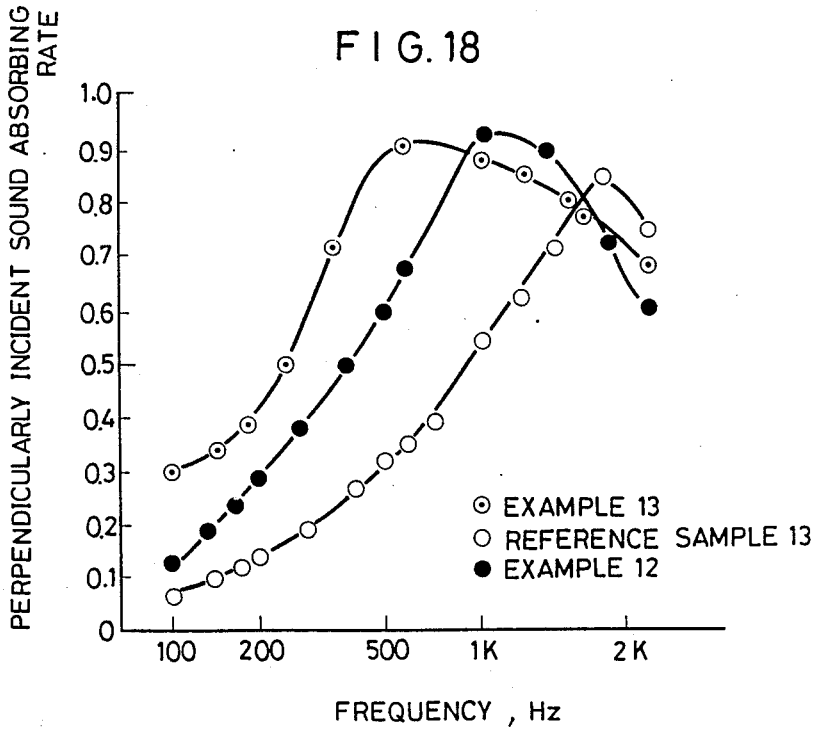
FIGS. 18 to 20 are diagrams illustrating the measurement results of the embodiments of the present invention, respectively.
Figure 19:
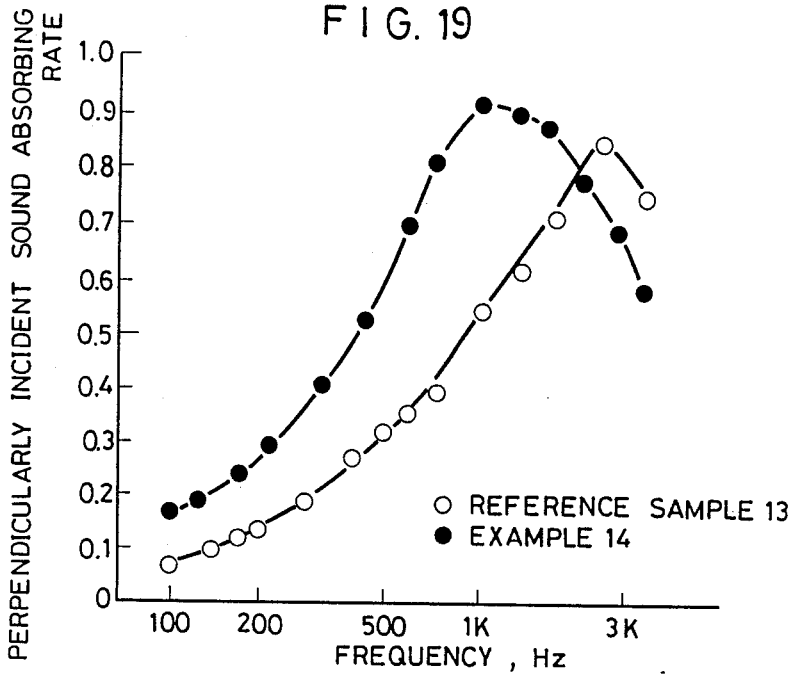
Figure 20:
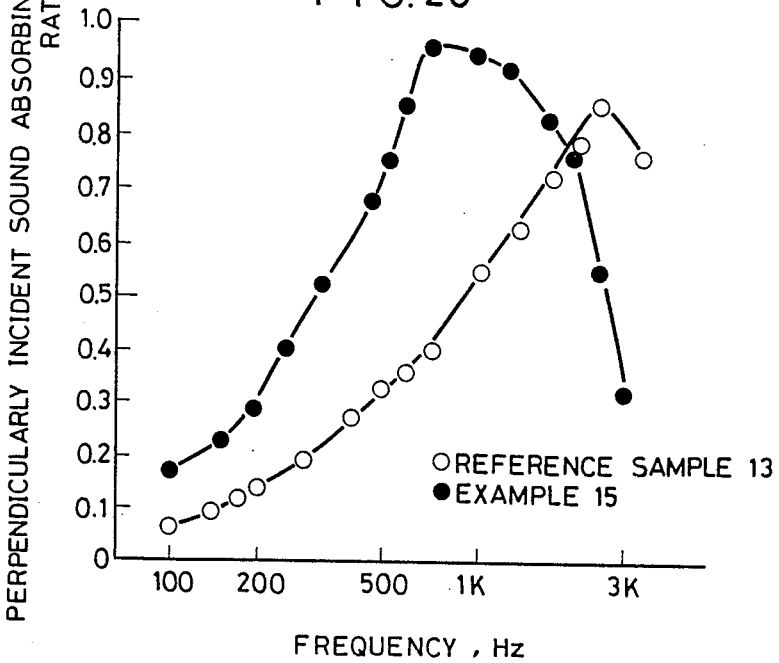

The results of the above measurement are shown in a diagram as shown in FIGS. 18 to 20.

On the other hand, Example 12 of the present invention is constructed of: the above porous metallic material having a thickness of 2 mm coated with an acrylic adhesive layer having a thickness of approximately 50 microns, which adhesive layer is applied to the surface of the porous metallic material in a spraying manner; and an acrylic fiber having a diameter of 60 microns and a length of 2.5 mm planted in the acrylic adhesive layer. The thus constructed Example 12 has an air-flow resistance of 210 g/sec.cm$^3$. The perpendicularly incident sound absorbing rate of the Example 12 is shown in a diagram shown in FIG. 18.

Experiment 6

Example 13 of the present invention is constructed of a web-like or network-like nylon adhesive sheet which is sandwiched between the porous metallic material as described in the above Experiment 5 and a cloth having an air-flow resistance of 96 g/sec.cm$^3$ so as to be bonded to them by a hot-melt adhesion process. The thus constructed Example 13 has an air-flow resistance of 450 g/sec.cm$^3$, and has the perpendicularly incident sound absorbing rate shown in FIG. 18.

Experiment 7

In the same process as that described in the Experiment 6, Example 14 of the present invention is constructed, provided that the web-like or network-like nylon adhesive sheet is sandwiched between the porous metallic material and a veneer having a thickness of 0.2 mm with an air-flow resistance of 150 g/sec.cm$^3$. The thus constructed Example 14 has an air-flow resistance of 460 g/sec.cm$^3$, and has the perpendicularly incident sound absorbing rate shown in FIG. 19.

Experiment 8

In the same process as that described in the Experiment 5, Example 15 of the present invention is constructed, provided that the porous metallic material is covered with a cork veneer bonded thereto by the use of a hot-melt phenol-resin type adhesive, which cork veneer has a thickness of 5 mm, a porosity of 30% and an air-flow resistance of 300 g/sec.cm$^3$. The thus constructed Example 5 has the perpendicularly incident sound absorbing rate shown in FIG. 20.

The following Table 4 shows the results of the above experiments:

TABLE 4

| | DECORATIVE LAYER | | | | |
|---|---|---|---|---|---|
| | MATERIAL KIND | MATERIAL CHARACTER | AIR-FLOW RESISTANCE (g/sec · cm$^3$) | AIR-FLOW RESISTANCE (g/sec · cm$^3$) | PERPENDICULARLY INCIDENT SOUND ABSORBING RATE (50 mm AIR GAP) |
| REFERENCE SAMPLE 13 | — | — | — | 68 | see FIGS. 18 to 20 |
| EXAMPLE 12 | PLANTED FIBER | ACRYLIC FIBER DIAMETER 60 microns LENGTH: 2.5 mm | NON-MEASURABLE | 210 | see FIG. 18 |
| EXAMPLE 13 | CLOTH | THICKNESS: 1 mm | 96 | 450 | see FIG. 18 |
| EXAMPLE 14 | WOOD | THICKNESS: 0.2 mm | 150 | 460 | see FIG. 19 |
| EXAMPLE 15 | CORK | THICKNESS: 5 mm POROSITY: 30% | 300 | 500 | see FIG. 20 |

EMBODIMENT 4

The porous metallic material employed in the Example 1 of the Embodiment 1 of the present invention is shaped into a plate-like piece having convex/concave portions expressed in millimeter unit in FIG. 21*a*, which piece forms Example 16 of Embodiment 4 of the present invention and is fixed to the sound-barrier wall 23 by means of a screw. The reverberation absorption coefficient of the thus formed Example 16 is determined according to the test method defined in JIS A 1409-1967, and shown in FIG. 22.

Figure 22:
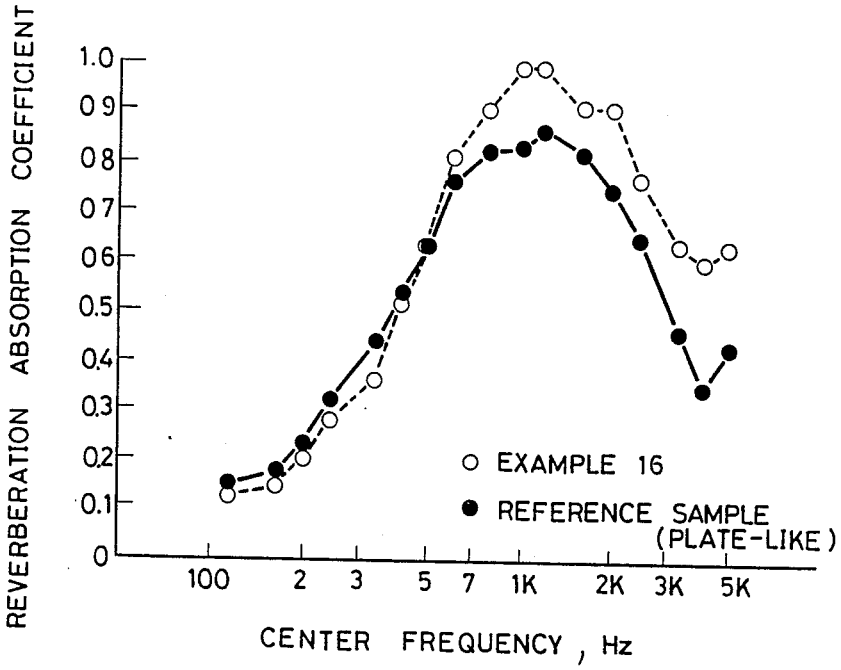
FIG. 22 is a diagram illustrating the measurement results of Example 16 of the present invention.

Incidentally, the porous metallic material employed in the Example 1 of the Embodiment 1 of the present invention is shaped into a flat plate-like piece to form a Reference sample the reverberation absorption coefficient of which is determined in the same method as that employed in the Example 16 of the present invention, provided that the air gap of 50 mm is provided in determination to form a sound absorbing space for the Reference sample. The thus obtained reverberation absorption coefficient of the Reference sample is also shown in FIG. 22.

Effect of the Invention (1) Since the metallic fiber and the expanded metal both of which are components of the porous metallic material of the present can be meshed with each other, the porous metallic material of the present invention is excellent in workability and manufacturing cost. In addition, in forming a sound absorbing member from the porous metallic material of the present invention through the bending work and like works thereof, there is no fear that the fine metallic dust is produced. Therefore, the porous metallic material of the present invention is a safe material as to the environmental health.

The method for manufacturing the porous metallic material of the present invention can reduce the manufacturing cost thereof, and makes it possible to manufacture a product excellent in sound absorbing efficiency and workability.

Further, by the use of the manufacturing method employing the roll for conducting the partial compression treatment, it is possible to produce a product of the porous metallic material of the present invention excellent in adhesion strength, and, therefore adapted for a member subjected to the external force such as vibrations and the like.

In addition, by the use of the manufacturing method employing additionally the heating treatment which is conducted after the above partial compression treatment, it is possible to further increase the adhesion strength of the product of the porous metallic material of the present invention.

(2) Since the sound absorbing structural element of the present invention has a unique construction, such element is further excellent in sound absorbing properties.

(3) Since the porous structural material of the present invention is the laminate constructed of: the rigid plate; the interposed structural element; and the porous metallic material, such porous structural material is excellent in sound absorbing efficiency, air-permeability and structural strength, and is light in weight.

Further, the porous metallic material of the present invention employing the laminate constructed of the expanded metal and the metallic fiber is excellent in bending strength and fire-resistance.

In this connection, in case that both of the expanded metal and the metallic fiber are made of aluminum, it is possible to further decrease both of the weight and the manufacturing cost of the porous structural material of the present invention, and also possible to manufacture the same in an easier manner without deteriorating the above-mentioned properties thereof.

According to the manufacturing method of the present invention, it is possible to obtain a firmly bonded product of the porous structural material of the present invention without excessively closing the pore and the communication-holes thereof, so that the thus obtained product is excellent in sound absorbing efficiency and structural strength.

In addition, in case that the heating treatment or the partial compression treatment conducted by means of the roll having the surface projection is employed in manufacturing of the porous metallic material of the present invention, it is possible to further increase the structural strength of the porous structural material which is constructed of the porous metallic material of the present invention.

Of the porous structural materials, one employing the double-faced adhesive tape or the adhesive sheet for bonding the rigid plate to the interposed structural element is superior, in sound absorbing properties, to another one in which the interposed structural element is simply superimposed over the rigid plate.

(4) The porous decorative sound absorbing material of the present invention is also excellent in corrosion resistance and appearance in addition to its excellent sound absorbing properties, and, therefore it is widely employed as the sound absorbing material for the building use, the office automation instrument use and like uses.

What is claimed is:

1. A method for manufacturing a porous metallic material adapted to be used for a sound absorbing construction material comprising preparing an aluminum-based metal fiber having a length of at least 1 cm and a diameter of 20 to 250 $\mu$ by spinning the fiber from a molten aluminum-based metal, felting said aluminum-based metal fiber to produce a felted aluminum-based metal fiber layer, and applying and pressing an expanded aluminum-based metal onto at least one surface of said felted aluminum based metal fiber layer under a pressure sufficient to pressure-bond said expanded metal to said metal fiber layer.

2. The method for manufacturing the porous metallic material, as set forth in claim 1, wherein said pressure is applied by means of a roll or platen provided with a projection.

3. A method for manufacturing a porous structural material adapted to be used for a sound absorbing construction material comprising preparing a porous metallic material of claim 1 securing a structural element provided with a plurality of tubular holes in communication with pores of the porous metallic material onto said porous metallic material and securing a rigid sheet onto said structural element.

4. The method for manufacturing the porous structural material, as set forth in claim 3, wherein said structural element is bonded to said porous metallic material through a double-faced adhesive tape.

5. The method for manufacturing the porous structural material, as set forth in claim 3, wherein said structural element is bonded to said porous metallic material through an adhesive sheet.

6. The method for manufacturing the porous structural material, as set forth in claim 3, wherein said pressure is applied by means of a roll or platen provided with a projection.

* * * * *

UNITED STATES PATENT AND TRADEMARK OFFICE

CERTIFICATE OF CORRECTION

PATENT NO. : 4,834,281

DATED : May 30, 1989

INVENTOR(S) : Toru Morimoto et al

It is certified that error appears in the above-identified patent and that said Letters Patent is hereby corrected as shown below:

Column 3, line 22, change "13d d" to --13d--;
line 63, change "(4" to --(4)--.

Column 8, line 22, after "adhesive" insert --tape 9 is--;
line 63, change "mean" to --means--.

Column 9, line 14, change "time" to --time:--;
line 16, change "pressure" to --pressure:--;

Column 13, line 22, change "(iv)" to --(iv).--.

Column 14, line 3, change ""67"" to --"δ"--.

Column 16, line 7, change "50" to --50%--;
line 61, change "par" to --pair--;
line 63, change "g/sec $cm^3$" to --g/sec·$cm^3$--.

UNITED STATES PATENT AND TRADEMARK OFFICE

CERTIFICATE OF CORRECTION

PATENT NO. : 4,834,281

DATED : May 30, 1989

INVENTOR(S) : Toru MORIMOTO et al.

It is certified that error appears in the above—identified patent and that said Letters Patent is hereby corrected as shown below:

Column 17, line 46, change "5" to --15--;
in Table 4, Example 12, change "DIAMETER" to --DIAMETER:--;
in Table 4, Example 13, insert the line:
--POROSITY: 50%--;
in Table 4, Example 14, insert the line:
--POROSITY: 30%--.

Column 18, rewrite lines 17-19 as follows:
--tion coefficient of the Reference sample is also shown in FIG. 22.--.

Column 20, line 25, change "1" to --1,--;
line 29, change "material" to --material,--.

Signed and Sealed this

Ninth Day of October, 1990

*Attest:*

*Attesting Officer*

HARRY F. MANBECK, JR.

*Commissioner of Patents and Trademarks*